US011591673B2

(12) United States Patent
Higami et al.

(10) Patent No.: US 11,591,673 B2
(45) Date of Patent: Feb. 28, 2023

(54) COPPER ALLOY PLATE AND METHOD FOR PRODUCING SAME

(71) Applicant: Dowa Metaltech Co., Ltd., Tokyo (JP)

(72) Inventors: Naota Higami, Tokyo (JP); Takanobu Sugimoto, Tokyo (JP); Kazuki Yoshida, Tokyo (JP); Hiroto Narieda, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 133 days.

(21) Appl. No.: 16/979,206

(22) PCT Filed: Feb. 20, 2019

(86) PCT No.: PCT/JP2019/006273

§ 371 (c)(1),
(2) Date: Sep. 9, 2020

(87) PCT Pub. No.: WO2019/171951

PCT Pub. Date: Sep. 12, 2019

(65) Prior Publication Data

US 2020/0407824 A1 Dec. 31, 2020

(30) Foreign Application Priority Data

Mar. 9, 2018 (JP) ..... JP2018-043010

(51) Int. Cl.
*C22C 9/04* (2006.01)
*C22F 1/08* (2006.01)

(52) U.S. Cl.
CPC . *C22C 9/04* (2013.01); *C22F 1/08* (2013.01)

(58) Field of Classification Search
CPC ..... C22C 9/04; C22F 1/08; H01B 1/026
See application file for complete search history.

(56) References Cited

FOREIGN PATENT DOCUMENTS

| | | | | | |
|---|---|---|---|---|---|
| JP | 2001164328 | A | | 6/2001 | |
| JP | 2002088428 | A | | 3/2002 | |
| JP | 2009062610 | A | * | 3/2009 | ..... C22C 9/04 |
| JP | 2009062610 | A | | 3/2009 | |
| JP | 2018070944 | A | | 5/2018 | |
| WO | 2004022805 | A1 | | 3/2004 | |

OTHER PUBLICATIONS

Ko et al., JP 2009/062610A, machine translation. (Year: 2009).*
International search report for patent application No. PCT/JP2019/006273 dated Jul. 5, 2019.

* cited by examiner

*Primary Examiner* — John A Hevey
(74) *Attorney, Agent, or Firm* — Bachman & LaPointe, P.C.

(57) ABSTRACT

There are provided an inexpensive copper alloy plate having excellent bending workability, excellent stress corrosion cracking resistance and excellent stress relaxation resistance while maintaining the high strength thereof, and a method for producing the same. The copper alloy plate has a chemical composition which contains 17 to 32% by weight of zinc, 0.1 to 4.5% by weight of tin, 0.5 to 2.0% by weight of silicon, 0.01 to 0.3% by weight of phosphorus and the balance being copper and unavoidable impurities, wherein the total of the content of silicon and six times as much as the content of phosphorus is 1% by weight or more and wherein the copper alloy plate has a crystal orientation satisfying $I\{220\}/I\{420\} \leq 2.0$ assuming that the X-ray diffraction intensity on {220} crystal plane on the plate surface of the copper alloy plate is I{220} and that the X-ray diffraction intensity on {420} crystal plane thereon is I{420}.

14 Claims, No Drawings

COPPER ALLOY PLATE AND METHOD FOR PRODUCING SAME

TECHNICAL FIELD

The present invention generally relates to a copper alloy plate and a method for producing the same. More specifically, the invention relates to a copper alloy plate, such as a Cu—Zn—Sn alloy plate, which is used for electric and electronic parts, such as connectors, lead frames, relays and switches, and a method for producing the same.

BACKGROUND ART

The materials used for electric and electronic parts, such as connectors, lead frames, relays and switches, are required to have a good electric conductivity in order to suppress the generation of Joule heat due to the carrying of current, as well as such a high strength that the materials can withstand the stress applied thereto during the assembly and operation of electric and electronic apparatuses using the parts. The materials used for electric and electronic parts, such as connectors, are also required to have excellent bending workability since the parts are generally formed by bending. Moreover, in order to ensure the contact reliability between electric and electronic parts, such as connectors, the materials used for the parts are required to have excellent stress relaxation resistance, i.e., resistance to such a phenomenon (stress relaxation) that the contact pressure between the parts is deteriorated with age.

In recent years, there is a tendency for electric and electronic parts, such as connectors, to be integrated, miniaturized and lightened. In accordance therewith, the plates of copper and copper alloys serving as the materials of the parts are required to be thinned, so that the required strength level of the materials is more severe. In accordance with the miniaturization and complicated shape of electric and electronic parts, such as connectors, it is required to improve the precision of shape and dimension of products manufactured by bending the copper alloy plates. In recent years, there is a tendency to proceed with the decrease of environmental load, saving resources and saving energy. In accordance therewith, the plates of copper and copper alloys serving as the materials of the parts are increasingly required to decrease the raw material costs and production costs and to recycle the products thereof.

However, there are trade-off relationships between the strength and electric conductivity of a plate, between the strength and bending workability thereof and between the bending workability and stress relaxation resistance thereof, respectively. For that reason, a relatively low-cost plate having good electric conductivity, strength, bending workability or stress relaxation resistance is suitably chosen in accordance with the use thereof as conventional plates used for electric and electronic parts, such as connectors.

As conventional general-purpose materials for electric and electronic parts such as connectors, there are used brasses, phosphor bronzes and so forth. Phosphor bronzes have a relatively excellent balance between the strength, corrosion resistance, stress corrosion cracking resistance and stress relaxation resistance of a plate thereof. However, for example, in the case of the second-class phosphor bronze (C5191), it is not possible to carry out the hot rolling of a plate thereof, and it contains about 6% of expensive tin, so that the costs of the plate thereof are increased.

On the other hand, brasses (Cu—Zn alloys) are widely used as materials having low raw material costs and low production costs and having excellent recycling efficiencies of products thereof. However, the strength of brasses is lower than that of phosphor bronzes. The temper designation of a brass having the highest strength is EH (H06). For example, the plate product of the first-class brass (C2600-SH) generally has a tensile strength of about 550 MPa which is comparable with the tensile strength of the temper designation H (H04) of the second-class phosphor bronze. In addition, the plate product of the first-class brass (C2600-SH) does not have excellent stress corrosion cracking resistance.

In order to improve the strength of brasses, it is required to increase the finish rolling reduction (to increase the temper designation). In accordance therewith, the bending workability in directions perpendicular to the rolling directions (i.e., the bending workability in directions in which the bending axis extends in directions parallel to the rolling directions) is remarkably deteriorated. For that reason, even if a brass having a high strength level is used as the material, there are some cases where it is not possible to work the plate to produce an electric and electronic part such as a connector. For example, if the finish rolling reduction of a plate of the first-class brass is increased to cause the tensile strength to be higher than 570 MPa, it is difficult to press the plate to produce a small product.

In particular, in the case of a brass being a simple alloy of copper and zinc, it is not easy to improve the bending workability thereof while maintaining the strength thereof. For that reason, there is improved to enhance the strength level by adding various elements to brasses. For example, there are proposed copper-zinc alloys wherein a third element, such as tin, silicon or nickel, is added thereto (see, e.g., Patent Documents 1-3).

PRIOR ART DOCUMENT(S)

Patent Document(s)

Patent Document 1: Japanese Patent Laid-Open No. 2001-164328 (Paragraph Number 0013)
Patent Document 2: Japanese Patent Laid-Open No. 2002-88428 (Paragraph Number 0014)
Patent Document 3: Japanese Patent Laid-Open No. 2009-62610 (Paragraph Number 0019)

SUMMARY OF THE INVENTION

Problem to be Solved by the Invention

However, even if tin, silicon, nickel or the like is added to a brass (a copper-zinc alloy), there are some cases where it is not possible to sufficiently improve the bending workability of a plate thereof. It is therefore an object of the present invention to eliminate the aforementioned conventional problems and to provide an inexpensive copper alloy plate having excellent bending workability, excellent stress corrosion cracking resistance and excellent stress relaxation resistance while maintaining the high strength thereof, and a method for producing the same.

Means for Solving the Problem

In order to accomplish the aforementioned object, the inventors have diligently studied and found that it is possible to produce an inexpensive copper alloy plate having excellent bending workability, excellent stress corrosion cracking resistance and excellent stress relaxation resistance while maintaining the high strength thereof, if the copper alloy plate has a chemical composition comprising 17 to 32% by weight of zinc, 0.1 to 4.5% by weight of tin, 0.5 to 2.0% by weight of silicon, 0.01 to 0.3% by weight of phosphorus, and the balance being copper and unavoidable impurities, the total of the content of silicon and six times as much as the content of phosphorus being 1% by weight or more, and if the copper alloy plate has a crystal orientation satisfying I{220}/I{420}≤2.0 assuming that the X-ray diffraction intensity on {220} crystal plane on the plate surface of the copper alloy plate is I{220} and that the X-ray diffraction intensity on {420} crystal plane thereon is I{420}. Thus, the inventors have made the present invention.

According to the present invention, there is provided a copper alloy plate which has a chemical composition comprising 17 to 32% by weight of zinc, 0.1 to 4.5% by weight of tin, 0.5 to 2.0% by weight of silicon, 0.01 to 0.3% by weight of phosphorus, and the balance being copper and unavoidable impurities, wherein the total of the content of silicon and six times as much as the content of phosphorus is 1% by weight or more, and wherein the copper alloy plate has a crystal orientation satisfying I{220}/I{420}≤2.0 assuming that the X-ray diffraction intensity on {220} crystal plane on the plate surface of the copper alloy plate is I{220} and that the X-ray diffraction intensity on {420} crystal plane thereon is I{420}.

The chemical composition of the copper alloy plate may further comprise 1% by weight or less of nickel or cobalt, and may further comprise one or more elements which are selected from the group consisting of iron, chromium, magnesium, aluminum, boron, zirconium, titanium, manganese, gold, silver, lead, cadmium and beryllium, the total amount of these elements being 3% by weight or less. The copper alloy plate preferably has a mean crystal grain size of 3 to 20 μm. The copper alloy plate preferably has a tensile strength of not lower than 550 MPa, and preferably has a 0.2% proof stress of not lower than 500 MPa. The copper alloy plate preferably has an electric conductivity of not lower than 8% IACS.

According to the present invention, there is provided a method for producing a copper alloy plate, the method comprising the steps of: melting and casting raw materials of a copper alloy which has a chemical composition comprising 17 to 32% by weight of zinc, 0.1 to 4.5% by weight of tin, 0.5 to 2.0% by weight of silicon, 0.01 to 0.3% by weight of phosphorus, and the balance being copper and unavoidable impurities, the total of the content of silicon and six times as much as the content of phosphorus being 1% by weight or more; hot-rolling the cast copper alloy at a rolling reduction of 90% or more in a temperature range of from 900° C. to 300° C., the hot-rolling being carried out at a rolling reduction of 10% or more in a rolling path in a temperature range of 650° C. or lower; intermediate cold-rolling the hot-rolled copper alloy; intermediate annealing the intermediate cold-rolled copper alloy at a temperature of 400 to 800° C.; finish cold-rolling the intermediate annealed copper alloy at a rolling reduction of 30% or less; and low-temperature annealing the finish cold-rolled copper alloy at a temperature of 450° C. or lower.

In this method for producing a copper alloy plate, the rolling reduction in the rolling path in the temperature range of 650° C. or lower in the hot-rolling is preferably 35% or less. In the intermediate annealing, a heat treatment is preferably carried out by setting a holding time and an attainment temperature in a temperature range of from 400° C. to 800° C. so that the copper alloy has a mean crystal grain size of 3 to 20 μm after the intermediate annealing.

In the method for producing a copper alloy plate, the chemical composition of the copper alloy plate may further comprise 1% by weight or less of nickel or cobalt, and may further comprise one or more elements which are selected from the group consisting of iron, chromium, magnesium, aluminum, boron, zirconium, titanium, manganese, gold, silver, lead, cadmium and beryllium, the total amount of these elements being 3% by weight or less. The intermediate cold-rolling and the intermediate annealing may be alternately repeated multiple times.

According to the present invention, there is provided a connector terminal, the material of which is the above-described copper alloy plate.

Effects of the Invention

According to the present invention, it is possible to produce an inexpensive copper alloy plate having excellent bending workability, excellent stress corrosion cracking resistance and excellent stress relaxation resistance while maintaining the high strength thereof.

MODE FOR CARRYING OUT THE INVENTION

The preferred embodiment of a copper alloy plate according to the present invention has a chemical composition comprising 17 to 32% by weight of zinc, 0.1 to 4.5% by weight of tin, 0.5 to 2.0% by weight of silicon, 0.01 to 0.3% by weight of phosphorus, and the balance being copper and unavoidable impurities, the total of the content of silicon and six times as much as the content of phosphorus being 1% by weight or more, and has a crystal orientation satisfying I{220}/I{420}≤2.0 assuming that the X-ray diffraction intensity on {220} crystal plane on the plate surface of the copper alloy plate is I{220} and that the X-ray diffraction intensity on {420} crystal plane thereon is I{420}.

The preferred embodiment of a copper alloy plate according to the present invention is a Cu—Zn—Sn—Si—P alloy wherein Sn, Si and P are added to a Cu—Zn alloy containing Cu and Zn.

Assuming that the X-ray diffraction intensity on {220} crystal plane on the plate surface of the copper alloy plate is I{220} and that the X-ray diffraction intensity on {420} crystal plane thereon is I{420}, the crystal orientation of the copper alloy plate satisfies I{220}/I{420}≤2.0 (preferably satisfies I{220}/I{420}≤1.8). If I{220}/I{420} is too large, the bending workability is deteriorated.

Zinc has the function of improving the strength and spring property of the copper alloy plate. Since zinc is cheaper than copper, a large amount of zinc is preferably added to the copper alloy. However, if the content of zinc exceeds 32% by weight, beta (β) phase is generated to remarkably lower the cold workability of the copper alloy plate and the stress corrosion cracking resistance thereof, and to lower the plating and soldering properties thereof due to moisture and heating. On the other hand, if the content of zinc is less than 17% by weight, the strength, such as 0.2% proof stress and tensile strength, and spring property of the copper alloy plate are insufficient, and the Young's modulus thereof is increased. In addition, the amount of hydrogen gas absorption is increased during the melting of the copper alloy plate, and blowholes are easily generated in the ingot of the copper alloy. Moreover, the amount of inexpensive zinc is small in the copper alloy plate, so that the costs thereof are increased. Therefore, the content of zinc is preferably 17 to 32% by weight, more preferably 17 to 27% by weight, and most preferably 18 to 23% by weight.

Tin has the function of improving the strength, stress relaxation resistance and stress corrosion cracking resistance of the copper alloy plate. In order to reuse the materials, which are surface-treated with tin, such as tin-plated materials, the copper alloy plate preferably contains tin. However, if the content of tin in the copper alloy plate exceeds 4.5% by weight, the electric conductivity of the copper alloy plate is suddenly lowered, and the segregation in the grain boundaries of the copper alloy is violently increased in the presence of zinc, so that the hot workability of the copper alloy plate is remarkably lowered. On the other hand, if the content of tin is less than 0.1% by weight, the function of improving the mechanical characteristics of the copper alloy plate is decreased, and it is difficult to use pressed scraps and so forth, which are plated with tin, as the raw materials of the copper alloy plate. Therefore, the content of tin is preferably 0.1 to 4.5% by weight, and more preferably 0.2 to 2.5% by weight.

Silicon has the function of improving the stress corrosion cracking resistance of the copper alloy plate even if the content of silicon therein is small. In order to sufficiently obtain this function, the content of silicon is preferably not less than 0.5% by weight. However, if the content of silicon exceeds 2.0% by weight, the electric conductivity of the copper alloy plate is easily lowered. In addition, silicon is an easily oxidized element to easily lower the castability of the copper alloy, so that the content of silicon is preferably not too large. Therefore, the content of silicon is preferably 0.5 to 2.0% by weight, and more preferably 0.5 to 1.9% by weight.

Phosphorus has the function of improving the stress corrosion cracking resistance of the copper alloy plate even if the content of silicon therein is small. In order to sufficiently obtain this function, the content of phosphorus is preferably larger than 0.01% by weight. However, if the content of phosphorus exceeds 0.3% by weight, the electric conductivity of the copper alloy plate is easily lowered. Therefore, the content of phosphorus is preferably 0.01 to 0.3% by weight, and more preferably 0.01 to 0.25% by weight.

Furthermore, if the total of the content of silicon and six times as much as the content of phosphorus is lower than 1% by weight, there is some possibility that it is not possible to sufficiently obtain the function of improving the stress corrosion cracking resistance of the copper alloy plate.

The chemical composition of the copper alloy plate may further comprise 1% by weight or less (preferably 0.7% by weight or less) of nickel or cobalt. The chemical composition of the copper alloy may further comprise one or more elements which are selected from the group consisting of iron, chromium, magnesium, aluminum, boron, zirconium, titanium, manganese, gold, silver, lead, cadmium and beryllium, the total amount of these elements being 3% by weight or less (preferably 1% by weight or less, more preferably 0.5% by weight or less).

The mean crystal grain size of the copper alloy plate is preferably 20 μm or less, more preferably 18 μm or less, and most preferably 17 μm or less, since the bending workability of the copper alloy plate is more advantageously improved as the mean crystal grain size of the copper alloy plate is smaller. On the other hand, the mean crystal grain size of the copper alloy plate is preferably 3 μm or more, and more preferably 4 μm or more, since there is some possibility that the stress relaxation resistance may be deteriorated if the mean crystal grain size of the copper alloy plate is too small.

The tensile strength of the copper alloy plate is preferably not lower than 550 MPa, and more preferably not lower than 580 MPa, in order to produce miniaturized and thinned electric and electronic parts, such as connectors. In addition, the 0.2% proof stress of the copper alloy plate is preferably not lower than 500 MPa, and more preferably not lower than 520 MPa.

The electric conductivity of the copper alloy plate is preferably not lower than 8% IACS, and more preferably not lower than 8.5% IACS, in order to suppress the generation of Joule heat due to the carrying of current in accordance with the high integration of electric and electronic parts, such as connectors.

In order to evaluate the stress relaxation resistance of the copper alloy plate, in accordance with the cantilever screw type stress relaxation test prescribed in JEITA EMAS-1011, a test piece (having a length of 60 mm×a width of 10 mm) is cut from the copper alloy plate so that the longitudinal directions of the test piece are directions LD (the rolling directions of the copper alloy plate) while the width directions are directions TD (directions perpendicular to the rolling and thickness directions of the copper alloy plate). One end portion of the test piece in longitudinal directions thereof is fixed, and the other end portion of the test piece in longitudinal directions thereof is fixed in a state that a load stress corresponding to 80% of the 0.2% proof stress thereof is applied at a position corresponding to a span length of 30 mm on the other end portion thereof so that the thickness directions of the test piece are deflection directions. After this test piece is held at 150° C. for 500 hours, the deflection of the test piece is measured. From the rate of variability in the deflection, a stress relaxation rate (%) is calculated. The stress relaxation rate is preferably not higher than 25%, more preferably not higher than 23%, and most preferably not higher than 22%.

In order to evaluate the stress corrosion cracking resistance of the copper alloy plate, a bending stress corresponding to 80% of the 0.2% proof stress thereof is applied to a test piece which is cut out from the copper alloy plate, and the test piece is held at 25° C. in a desiccator containing 3% by weight of ammonia water. With respect to the test piece taken out every one hour, the time when cracks are observed in the copper alloy plate at a magnification of 100 by means of an optical microscope is preferably not shorter than 100 hours, more preferably not shorter than 110 hours, and most preferably not shorter than 120 hours. This time is preferably longer than twenty times (more preferably longer than twenty-two times, and most preferably longer than twenty-four times) as long as the time (5 hours) in a plate of a commercially-available first-class brass (C2600-SH).

In order to evaluate the bending workability of the copper alloy plate, a bending test piece is cut out from the copper alloy plate so that the longitudinal directions of the bending test piece are directions TD (directions perpendicular to the rolling and thickness directions of the copper alloy plate). When the 90° W bending test (based on JIS H3130) of the bending test piece is carried out so that the bending axis of the bending test piece extends in directions LD (the rolling directions of the copper alloy plate), the ratio R/t of the minimum bending radius R to the thickness t of the bending test piece in the 90° W bending test is preferably not higher than 0.7, and more preferably not higher than 0.6.

The above-described copper alloy plate can be produced by the preferred embodiment of a method for producing a copper alloy plate according to the present invention. The preferred embodiment of a method for producing a copper alloy plate according to the present invention comprises: a melting/casting step of melting and casting raw materials of a copper alloy which has the above-described chemical composition; a hot-rolling step of hot-rolling the copper alloy at a rolling reduction of 90% or more in a temperature range of from 900° C. to 300° C. after the melting/casting step, the hot-rolling being carried out at a rolling reduction of 10% or more (preferably 10 to 35%) in a rolling path in a temperature range of 650° C. or lower (preferably from 650° C. to 300° C.); an intermediate cold-rolling step of cold-rolling the copper alloy after the hot-rolling step; an intermediate annealing step of annealing the copper alloy at a temperature of 400 to 800° C. after the intermediate cold-rolling step; a finish cold-rolling step of finish cold-rolling the copper alloy at a rolling reduction of 30% or less after the intermediate annealing step; and a low-temperature annealing step of annealing the copper alloy at a temperature of 450° C. or less after the finish cold-rolling step. These steps will be described below in detail. Furthermore, facing may be optionally carried out after the hot rolling step. After each heat treatment, pickling, polishing, degreasing and so forth may be optionally carried out.

(Melting and Casting Step)

After the raw materials of a copper alloy are melted by the same method as a usual method for ingoting a brass, an ingot is produced by the continuous casting, semi-continuous casting or the like. Furthermore, when the raw materials may be melted in the atmosphere (i.e., an air atmosphere under ordinary pressure).

(Hot Rolling Step)

The hot rolling of a copper-zinc alloy is usually carried out in a high temperature range of not lower than 650° C. or 700° C. in order to cause the destruction of the cast structure and the softening of the materials by recrystallization during the rolling and between the rolling paths. However, on such general hot-rolling conditions, it is difficult to produce a copper alloy plate having a specific texture as the preferred embodiment of a copper alloy plate according to the present invention. That is, even if conditions at subsequent steps are widely changed on such general hot-rolling conditions, it is difficult to produce a copper alloy plate having a crystal orientation satisfying $I\{220\}/I\{420\} \leq 2.0$ assuming that the X-ray diffraction intensity on {220} crystal plane on the plate surface of the copper alloy plate is I{220} and that the X-ray diffraction intensity on {420} crystal plane thereon is I{420}. For that reason, in the preferred embodiment of a method for producing a copper alloy plate according to the present invention, the hot-rolling is carried out at a rolling reduction of 90% or more in a temperature range of from 900° C. to 300° C. at the hot-rolling step while a rolling reduction in a rolling path in a temperature range of 650° C. or lower (preferably from 650° C. to 300° C.) is 10% or more (preferably 10 to 35%, and more preferably 10 to 20%). Furthermore, when the hot rolling of the ingot is carried out, if the initial rolling pass is carried out in a higher temperature range than 600° C. at which recrystallization is easy to occur, it is possible to break the cast structure of the ingot to uniform the components and structures thereof.

However, if the hot rolling of the ingot is carried out at a high temperature exceeding 900° C., there is some possibility that cracks may be produced in portions, such as segregation portions of alloy components, at which the melting point is lowered, so that it is not preferable to carry out the hot rolling of the ingot at a high temperature exceeding 900° C.

(Intermediate Cold Rolling Step)

At this cold rolling step, the rolling reduction is preferably not less than 50%, more preferably not less than 60%, and most preferably not less than 70%.

(Intermediate Annealing Step)

At this intermediate annealing step, annealing is carried out at a temperature of 400 to 800° C. (preferably 400 to 700° C.). At this intermediate annealing step, a heat treatment is preferably carried out by setting a holding time and an attainment temperature in a temperature range of from 400° C. to 800° C. (preferably from 400° C. to 700° C., and more preferably from 450° C. to 650° C.) so that the mean crystal grain size after the annealing is not greater than 20 μm (preferably not greater than 18 μm, and more preferably not greater than 17 μm) and is not less than 3 μm (preferably not less than 4 μm). Furthermore, the particle diameters of recrystallized grains obtained by this annealing are varied in accordance with the rolling reduction in the cold rolling before the annealing and in accordance with the chemical composition thereof. However, if the relationship between the annealing heat pattern and the mean crystal grain size is previously obtained by experiments with respect to each of various alloys, it is possible to set the holding time and attainment temperature at a temperature of 400 to 800° C. Specifically, in the case of the chemical composition of the copper alloy plate according to the present invention, it is possible to set appropriate conditions in heating conditions for holding at a temperature of 400 to 800° C. for a few seconds to a few hours. Furthermore, the intermediate cold-rolling step and the intermediate annealing step may be repeated in this order. When the intermediate cold-rolling step and the intermediate annealing step are repeated, a heat treatment is preferably carried out at a temperature, which is not lower than that at other intermediate annealing steps, at the final intermediate annealing (recrystallization annealing) step. The heat treatment at the final intermediate annealing step is preferably carried out by setting a holding time and an attainment temperature in a temperature range of from 400° C. to 800° C. (preferably from 400° C. to 700° C., and more preferably from 450° C. to 650° C.) so that the mean crystal grain size after the annealing is not greater than 20 μm (preferably not greater than 18 μm, and more preferably not greater than 17 μm) and is not less than 3 μm (preferably not less than 4 μm).

(Finish Cold Rolling Step)

The finish cold rolling is carried out in order to improve the strength level of the copper alloy plate. If the rolling reduction in the finish cold-rolling is too low, a rolling texture having the {220} orientation as a principal orientation component is developed as the increase of the rolling reduction in finish cold-rolling although the strength of the copper alloy plate is low. On the other hand, if the rolling reduction in the finish cold rolling is too high, the rolling texture on the {220} orientation is relatively too strong, so that it is not possible to obtain a crystal orientation wherein both of strength and bending workability are improved. For that reason, the rolling reduction in the finish cold rolling is required to be 30% or less, and is more preferably 5 to 29% and most preferably 10 to 28%. By carrying out such finish cold-rolling, it is possible to maintain a crystal orientation satisfying $I\{220\}/I\{420\} \leq 2.0$. Furthermore, the final thickness of the copper alloy plate is preferably in the range of from about 0.02 mm to about 1.0 mm, more preferably in the range of from 0.05 mm to 0.5 mm, and most preferably 0.05 mm to 0.3 mm.

(Low-Temperature Annealing Step)

After carrying out the finish cold rolling, the low-temperature annealing may be carried out in order to improve the stress corrosion cracking resistance and bending workability of the copper alloy plate due to the decrease of the residual stress of the copper alloy plate and in order to improve the stress relaxation resistance of the copper alloy plate due to the decrease of dislocation in vacancies and on the slip plane. Particularly in the case of a copper-zinc alloy, it is required to carry out the low-temperature annealing at a temperature of not higher than 450° C., and the low-temperature annealing is preferably carried out at a heating temperature of 150 to 400° C. (more preferably carried out at a temperature of 300 to 400° C.) (a lower temperature than the annealing temperature at the intermediate annealing step). By this low-temperature annealing, it is possible to improve all of the strength, stress corrosion cracking resistance, bending workability and stress relaxation resistance of the copper alloy plate, and it is also possible to enhance the electric conductivity thereof. If the heating temperature is too high, the copper alloy plate is softened in a short period of time, so that variations in characteristics are easily caused in either of batch and continuous systems. On the other hand, if the heating temperature is too low, it is possible to sufficiently obtain the function of improving the above-described characteristics. The holding time at this heating temperature is preferably 5 seconds or more, and it is possible to usually obtain good results if the holding time is within 1 hour.

EXAMPLES

The examples of a copper alloy plate and a method for producing the same according to the present invention will be described below in detail.

Examples 1-18 and Comparative Examples 1-5

There were melted a copper alloy containing 20% by weight of zinc, 0.79% by weight of tin, 1.9% by weight of silicon, 0.05% by weight of phosphorus and the balance being copper (Example 1), a copper alloy containing 20% by weight of zinc, 0.80% by weight of tin, 1.9% by weight of silicon, 0.10% by weight of phosphorus and the balance being copper (Example 2), a copper alloy containing 20% by weight of zinc, 0.79% by weight of tin, 1.9% by weight of silicon, 0.20% by weight of phosphorus and the balance being copper (Example 3), a copper alloy containing 20% by weight of zinc, 0.78% by weight of tin, 1.1% by weight of silicon, 0.05% by weight of phosphorus and the balance being copper (Example 4), a copper alloy containing 20% by weight of zinc, 0.80% by weight of tin, 1.0% by weight of silicon, 0.10% by weight of phosphorus and the balance being copper (Example 5), a copper alloy containing 20% by weight of zinc, 0.79% by weight of tin, 1.0% by weight of silicon, 0.20% by weight of phosphorus and the balance being copper (Example 6), a copper alloy containing 20% by weight of zinc, 0.79% by weight of tin, 0.5% by weight of silicon, 0.10% by weight of phosphorus and the balance being copper (Example 7), a copper alloy containing 20% by weight of zinc, 0.80% by weight of tin, 0.5% by weight of silicon, 0.20% by weight of phosphorus and the balance being copper (Example 8), a copper alloy containing 20% by weight of zinc, 0.78% by weight of tin, 1.0% by weight of silicon, 0.02% by weight of phosphorus and the balance being copper (Example 9), a copper alloy containing 30% by weight of zinc, 0.20% by weight of tin, 1.8% by weight of silicon, 0.10% by weight of phosphorus and the balance being copper (Example 10), a copper alloy containing 20% by weight of zinc, 2.10% by weight of tin, 1.7% by weight of silicon, 0.10% by weight of phosphorus and the balance being copper (Example 11), a copper alloy containing 20% by weight of zinc, 0.80% by weight of tin, 1.7% by weight of silicon, 0.10% by weight of phosphorus and the balance being copper (Example 12), a copper alloy containing 20% by weight of zinc, 0.80% by weight of tin, 1.8% by weight of silicon, 0.10% by weight of phosphorus, 0.5% by weight of nickel, and the balance being copper (Example 13), a copper alloy containing 19% by weight of zinc, 0.78% by weight of tin, 1.8% by weight of silicon, 0.10% by weight of phosphorus, 0.5% by weight of cobalt and the balance being copper (Example 14), a copper alloy containing 20% by weight of zinc, 0.77% by weight of tin, 1.9% by weight of silicon, 0.10% by weight of phosphorus, 0.15% by weight of iron, 0.07% by weight of chromium, 0.08% by weight of manganese and the balance being copper (Example 15), a copper alloy containing 20% by weight of zinc, 0.80% by weight of tin, 1.7% by weight of silicon, 0.10% by weight of phosphorus, 0.08% by weight of magnesium, 0.08% by weight of aluminum, 0.1% by weight of zirconium, 0.1% by weight of titanium and the balance being copper (Example 16), a copper alloy containing 20% by weight of zinc, 0.80% by weight of tin, 1.7% by weight of silicon, 0.10% by weight of phosphorus, 0.05% by weight of boron, 0.05% by weight of lead, 0.1% by weight of beryllium and the balance being copper (Example 17), a copper alloy containing 21% by weight of zinc, 0.79% by weight of tin, 1.9% by weight of silicon, 0.10% by weight of phosphorus, 0.05% by weight of gold, 0.08% by weight of silver, 0.08% by weight of lead, 0.07% by weight of cadmium and the balance being copper (Example 18), a copper alloy containing 20% by weight of zinc, 0.80% by weight of tin, 0.20% by weight of phosphorus and the balance being copper (Comparative Example 1), a copper alloy containing 20% by weight of zinc, 0.80% by weight of tin and the balance being copper (Comparative Example 2), a copper alloy containing 20% by weight of zinc, 0.79% by weight of tin, 0.5% by weight of silicon and the balance being copper (Comparative Example 3), a copper alloy containing 19% by weight of zinc, 0.77% by weight of tin, 1.0% by weight of silicon and the balance being copper (Comparative Example 4), and a copper alloy containing 20% by weight of zinc, 0.80% by weight of tin, 1.9% by weight of silicon, 0.10% by weight of phosphorus and the balance being copper (Comparative Example 5), respectively. Then, the melted copper alloys were cast to obtain ingots, and cast pieces having a size of 100 mm×100 mm×100 mm were cut out from the ingots, respectively. Furthermore, the total (6P+Si) of the content of silicon (Si) and six times (6P) as much as the content of phosphorus (P) in each of the copper alloy plates was 2.2% by weight (Example 1), 2.5% by weight (Examples 2, 15, 18 and Comparative Example 5), 3.1% by weight (Example 3), 1.4% by weight (Example 4), 1.6% by weight (Example 5), 2.2% by weight (Example 6), 1.1% by weight (Examples 7 and 9), 1.7% by weight (Example 8), 2.4% by weight (Examples 10, 13 and 14), 2.3% by weight (Examples 11, 12, 16 and 17), 1.2% by weight (Comparative Example 1), 0% by weight (Comparative Example 2), 0.5% by weight (Comparative Example 3), and 1.0% by weight (Comparative Example 4), respectively.

After each of the cast pieces was heated at 750° C. for 30 minutes, it was hot-rolled in a temperature range of 900° C. to 300° C. so as to have a thickness of 10 mm (rolling reduction=90%). In a temperature range of from 650° C. to 300° C. in the temperature range of from 900° C. to 300° C., the hot-rolling was carried out at a rolling reduction of 15% (Examples 1-18) and 5% (Comparative Examples 1-5), respectively.

Then, each of the pieces was cold-rolled at a rolling reduction of 84% so as to have a thickness of 1.60 mm, and then, intermediate-annealed by holding it at 500° C. for 1 hour.

Then, each of the pieces was cold-rolled at a rolling reduction of 76% so as to have a thickness of 0.38 mm (Examples 1-3, 10 and 13-18), at a rolling reduction of 75% so as to have a thickness of 0.40 mm (Examples 4-6 and Comparative Example 4), at a rolling reduction of 74% so as to have a thickness of 0.42 mm (Examples 7-9, 12 and Comparative Example 3), at a rolling reduction of 78% so as to have a thickness of 0.35 mm (Example 11), at a rolling reduction of 72% so as to have a thickness of 0.45 mm (Comparative Examples 1-2), and at a rolling reduction of 77% so as to have a thickness of 0.37 mm (Comparative Example 5), respectively, and then, (final) intermediate-annealed (recrystallization-annealed) by holding it at 500° C. (Examples 1-3, 5-10, 15-18, Comparative Examples 1 and 3-4), 550° C. (Examples 4 and 11), 600° C. (Examples 12-14), 525° C. (Comparative Example 2) and 350° C. (Comparative Example 5), respectively, for 10 minutes.

Then, each of the pieces was finish cold-rolled at a rolling reduction of 21% so as to have a thickness of 0.30 mm (Examples 1-3, 10 and 13-18), at a rolling reduction of 25% so as to have a thickness of 0.30 mm (Examples 4-6 and Comparative Example 4), at a rolling reduction of 27% so as to have a thickness of 0.30 mm (Examples 7-9 and 12, Comparative Example 3), at a rolling reduction of 15% so as to have a thickness of 0.30 mm (Example 11), at a rolling reduction of 33% so as to have a thickness of 0.30 mm (Comparative Examples 1-2), and at a rolling reduction of 15% so as to have a thickness of 0.31 mm (Comparative Example 5), respectively, and then, low-temperature annealed by holding it at 350° C. (Examples 1-3, 7-8, 10-18 and Comparative Example 3), 300° C. (Examples 4, 9, Comparative Examples 1-2 and 5), and 325° C. (Examples 5-6 and Comparative Example 4), respectively, for 30 minutes.

Then, samples were cut out from the copper alloy plates thus obtained in Examples 1-18 and Comparative Examples 1-5, and the mean crystal grain size of the crystal grain structure, X-ray diffraction intensity, electric conductivity, tensile strength (0.2% proof stress and tensile strength), stress relaxation resistance, stress corrosion cracking resistance and bending workability thereof were examined as follows.

The mean crystal grain size of crystal grain structure of the copper alloy plate was measured by the method of section based on JIS H0501 by observing the surface (rolled surface) of the copper alloy plate by means of an optical microscope after the surface was polished and etched. As a result, the mean crystal grain size was 5 μm (Examples 1-10, 13-18 and Comparative Examples 1-4), 6 μm (Example 11), 15 μm (Example 12), and 2 μm (Comparative Example 5), respectively.

The measurement of the intensity of X-ray diffraction (the integrated intensity of X-ray diffraction) was carried out by measuring the integrated intensity I{220} of the diffraction peak on {220} plate and the integrated intensity I{420} of the diffraction peak on {420} plane with respect to the surface (rolled surface) of the sample by means of an X-ray diffractometer (XRD) (RINT 2000 produced by Rigaku Corporation) using a Cu tube on conditions containing a tube voltage of 40 kV and a tube current of 20 mA. These measured values were used for obtaining the X-ray diffraction intensity ratio I{220}/I{420}. As a result, the X-ray diffraction intensity ratio I{220}/I{420} was 1.6 (Examples 1-4, 6, 10-11, 13-14 and 17), 1.7 (Examples 5, 8 and 12), 1.8 (Examples 7 and 9), 1.5 (Examples 15-16 and 18), 2.6 (Comparative Example 1), 2.7 (Comparative Example 2), 2.5 (Comparative Examples 3-4), and 2.4 (Comparative Example 5), respectively.

The electric conductivity of the copper alloy plate was measured in accordance with the electric conductivity measuring method based on JIS H0505. As a result, the electric conductivity of the copper alloy plate was 10.1% IACS (Example 1), 9.6% IACS (Example 2), 9.3% IACS (Example 3), 14.2% IACS (Example 4), 13.4% IACS (Example 5), 13.0% IACS (Example 6), 16.0% IACS (Example 7), 15.8% IACS (Example 8), 14.2% IACS (Example 9), 14.0% IACS (Example 10), 8.9% IACS (Example 11), 9.6% IACS (Example 12), 10.4% IACS (Example 13), 10.1% IACS (Example 14), 9.6% IACS (Example 15), 9.8% IACS (Example 16), 9.5% IACS (Example 17), 9.6% IACS (Example 18), 24.1% IACS (Comparative Example 1), 25.5% IACS (Comparative Example 2), 16.0% IACS (Comparative Example 3), 13.0% IACS (Comparative Example 4), and 9.0% IACS (Comparative Example 5), respectively.

In order to evaluate the tensile strength serving as one of mechanical characteristics of the copper alloy plate, three test pieces (No. 5 test pieces based on JIS 22201) for tension test in the directions LD (rolling directions) were cut out from each of the copper alloy plates. Then, the tension test based on JIS 22241 was carried out with respect to each of the test pieces to derive the mean value of tensile strengths in the directions LD and the mean value of 0.2% proof stresses in the directions LD. As a result, the 0.2% proof stress and tensile strength in the directions LD were 524 MPa and 639 MPa (Example 1), 531 MPa and 640 MPa (Example 2), 535 MPa and 645 MPa (Example 3), 526 MPa and 585 MPa (Example 4), 532 MPa and 616 MPa (Example 5), 530 MPa and 600 MPa (Example 6), 545 MPa and 620 MPa (Example 7), 549 MPa and 612 MPa (Example 8), 576 MPa and 620 MPa (Example 9), 550 MPa and 650 MPa (Example 10), 620 MPa and 714 MPa (Example 11), 535 MPa and 610 MPa (Example 12), 534 MPa and 638 MPa (Example 13), 535 MPa and 640 MPa (Example 14), 532 MPa and 641 MPa (Example 15), 530 MPa and 635 MPa (Example 16), 530 MPa and 632 MPa (Example 17), 538 MPa and 640 MPa (Example 18), 533 MPa and 587 MPa (Comparative Example 1), 515 MPa and 600 MPa (Comparative Example 2), 570 MPa and 621 MPa (Comparative Example 3), 591 MPa and 645 MPa (Comparative Example 4), and 520 MPa and 639 MPa (Comparative Example 5), respectively.

The stress relaxation resistance of the copper alloy plate was evaluated by the cantilever screw type stress relaxation test prescribed in JEITA EMAS-1011).

Specifically, a test piece (having a length of 60 mm×a width of 10 mm) was cut from the copper alloy plate so that the longitudinal directions of the test piece were directions LD (rolling directions of the copper alloy plate) while the width directions thereof were directions TD (directions perpendicular to the rolling and thickness directions of the copper alloy plate). One end portion of the test piece in longitudinal directions thereof was fixed to a cantilever screw type deflection loading jig, and the other end portion of the test piece in longitudinal directions thereof was fixed in a state that a load stress corresponding to 80% of the 0.2% proof stress thereof was applied at a position corresponding to a span length of 30 mm on the other end portion thereof (by means of a deflection loading bolt) so that the thickness directions of the test piece were deflection directions. After this test piece was held at 150° C. for 500 hours, the deflection of the test piece was measured. From the rate of variability in the deflection, a stress relaxation rate (%) was calculated to evaluate the stress relaxation resistance of the copper alloy plate. As a result, the stress relaxation rate was 20% (Examples 1-2, 5-6, 10 and 14), 19% (Examples 3 and 15-16), 21% (Examples 4 and 7), 18% (Examples 8-9, 12 and 17), 16% (Example 11), 17% (Examples 13 and 18), 40% (Comparative Examples 1 and 5), and 45% (Comparative Example 2), respectively.

In order to evaluate the stress corrosion cracking resistance of the copper alloy plate, a test piece having a width of 10 mm cut out from the copper alloy plate was bent in the form of an arch so that the surface stress in the central portion of the test piece in the longitudinal directions thereof was 80% of the 0.2% yield stress thereof. In this state, the test piece was held at 25° C. in a desiccator containing 3% by weight of ammonia water. With respect to the test piece (having the width of 10 mm) taken out every one hour, cracks were observed at a magnification of 100 by means of an optical microscope to evaluate the stress corrosion cracking resistance. As a result, cracks were observed after 160 hours (Example 1), 199 hours (Example 2), 324 hours (Example 3), 135 hours (Example 4), 165 hours (Example 5), 250 hours (Example 6), 124 hours (Example 7), 150 hours (Example 8), 135 hours (Example 9), 185 hours (Example 10), 201 hours (Example 11), 189 hours (Example 12), 190 hours (Example 13), 200 hours (Example 14), 190 hours (Example 15), 205 hours (Example 16), 192 hours (Example 17), 199 hours (Example 18), 40 hours (Comparative Example 1), 30 hours (Comparative Example 2), 92 hours (Comparative Example 3), 95 hours (Comparative Example 4), and 180 hours (Comparative Example 5), respectively. The time when cracks were observed in the copper alloy plate was 32 times (Example 1), 40 times (Example 2), 65 times (Example 3), 27 times (Example 4), 33 times (Example 5), 50 times (Example 6), 25 times (Example 7), 30 times (Example 8), 27 times (Example 9), 37 times (Example 10), 40 times (Example 11), 38 times (Example 12), 38 times (Example 13), 40 times (Example 14), 38 times (Example 15), 41 times (Example 16), 38 times (Example 17), 40 times (Example 18), 8 times (Comparative Example 1), 6 times (Comparative Example 2), 18 times (Comparative Example 3), 19 times (Comparative Example 4), and 35 times (Comparative Example 5), respectively, as long as the time (5 hours) in a plate of a commercially-available first-class brass (C2600-SH).

In order to evaluate the bending workability of the copper alloy plate, a bending test piece (width=10 mm) was cut out from the copper alloy plate so that the longitudinal directions of the bending test piece were directions TD (directions perpendicular to the rolling and thickness directions of the copper alloy plate). Then, with respect to the bending test piece, the 90° W bending test based on JIS H3130 was carried out so that the bending axis of the bending test piece extended in directions LD (the rolling directions of the copper alloy plate) (Bad Way bending (B.W. bending)).

With respect to the bending piece after this test, the surface and cross-section of the bent portion thereof were observed at a magnification of 100 by means of an optical microscope to obtain a minimum bending radius R wherein cracks were not observed. Then, the minimum bending radius R was divided by the thickness t to derive the ratio R/t. As a result, the ratio R/t was 0.3 or less (Examples 1 and 9), 0.6 (Examples 2-3, 5-6, 8, 11-12, 14, 18 and Comparative Example 5), 0.3 (Examples 4, 7, 10, 13 and 15-17), 1.0 (Comparative Examples 1-2), and 0.8 (Comparative Examples 3-4), respectively.

The producing conditions and characteristics of the copper alloy plates in these examples and comparative examples are shown in Tables 1 through 4.

TABLE 1

| | Chemical Composition (% by weight) | | | | | | |
|---|---|---|---|---|---|---|---|
| | Cu | Zn | Sn | Si | P | Other Elements | 6P + Si |
| Ex. 1 | bal. | 20 | 0.79 | 1.9 | 0.05 | — | 2.2 |
| Ex. 2 | bal. | 20 | 0.80 | 1.9 | 0.10 | — | 2.5 |
| Ex. 3 | bal. | 20 | 0.79 | 1.9 | 0.20 | — | 3.1 |
| Ex. 4 | bal. | 20 | 0.78 | 1.1 | 0.05 | — | 1.4 |
| Ex. 5 | bal. | 20 | 0.80 | 1.0 | 0.10 | — | 1.6 |
| Ex. 6 | bal. | 20 | 0.79 | 1.0 | 0.20 | — | 2.2 |
| Ex. 7 | bal. | 20 | 0.79 | 0.5 | 0.10 | — | 1.1 |
| Ex. 8 | bal. | 20 | 0.80 | 0.5 | 0.20 | — | 1.7 |
| Ex. 9 | bal. | 20 | 0.78 | 1.0 | 0.02 | — | 1.1 |
| Ex. 10 | bal. | 30 | 0.20 | 1.8 | 0.10 | — | 2.4 |
| Ex. 11 | bal. | 20 | 2.10 | 1.7 | 0.10 | — | 2.3 |
| Ex. 12 | bal. | 20 | 0.80 | 1.7 | 0.10 | — | 2.3 |
| Ex. 13 | bal. | 20 | 0.80 | 1.8 | 0.10 | Ni0.5 | 2.4 |
| Ex. 14 | bal. | 19 | 0.78 | 1.8 | 0.10 | Co0.5 | 2.4 |
| Ex. 15 | bal. | 20 | 0.77 | 1.9 | 0.10 | Fe0.15, Cr0.07, Mn0.08 | 2.5 |
| Ex. 16 | bal. | 20 | 0.80 | 1.7 | 0.10 | Mg0.08, Al 0.08, Zr0.1, Ti0.1 | 2.3 |
| Ex. 17 | bal. | 20 | 0.80 | 1.7 | 0.10 | B0.05, Pb0.05, Be0.1 | 2.3 |
| Ex. 18 | bal. | 21 | 0.79 | 1.9 | 0.10 | Au0.05, Ag0.08, Pb0.08, Cd0.07 | 2.5 |
| Comp. 1 | bal. | 20 | 0.80 | 0 | 0.20 | — | 1.2 |
| Comp. 2 | bal. | 20 | 0.80 | 0 | 0 | — | 0 |
| Comp. 3 | bal. | 20 | 0.79 | 0.5 | 0 | — | 0.5 |
| Comp. 4 | bal. | 19 | 0.77 | 1.0 | 0 | — | 1.0 |
| Comp. 5 | bal. | 20 | 0.80 | 1.9 | 0.10 | — | 2.5 |

TABLE 2

| | Rolling Reduction (%) at 650° C. or lower in Hot Rolling | Final Intermediate Annealing (° C. × min.) | Rolling Reduction (%) in Finish Cold Rolling | Temp. (° C.) in Low Temp. Annealing |
|---|---|---|---|---|
| Ex. 1 | 15 | 500 × 10 | 21 | 350 |
| Ex. 2 | 15 | 500 × 10 | 21 | 350 |
| Ex. 3 | 15 | 500 × 10 | 21 | 350 |
| Ex. 4 | 15 | 550 × 10 | 25 | 300 |
| Ex. 5 | 15 | 500 × 10 | 25 | 325 |
| Ex. 6 | 15 | 500 × 10 | 25 | 325 |
| Ex. 7 | 15 | 500 × 10 | 27 | 350 |
| Ex. 8 | 15 | 500 × 10 | 27 | 350 |
| Ex. 9 | 15 | 500 × 10 | 27 | 300 |
| Ex. 10 | 15 | 500 × 10 | 21 | 350 |
| Ex. 11 | 15 | 550 × 10 | 15 | 350 |
| Ex. 12 | 15 | 600 × 10 | 27 | 350 |
| Ex. 13 | 15 | 600 × 10 | 21 | 350 |
| Ex. 14 | 15 | 600 × 10 | 21 | 350 |
| Ex. 15 | 15 | 500 × 10 | 21 | 350 |
| Ex. 16 | 15 | 500 × 10 | 21 | 350 |
| Ex. 17 | 15 | 500 × 10 | 21 | 350 |
| Ex. 18 | 15 | 500 × 10 | 21 | 350 |
| Comp. 1 | 5 | 500 × 10 | 33 | 300 |
| Comp. 2 | 5 | 525 × 10 | 33 | 300 |
| Comp. 3 | 5 | 500 × 10 | 27 | 350 |
| Comp. 4 | 5 | 500 × 10 | 25 | 325 |
| Comp. 5 | 5 | 350 × 10 | 15 | 300 |

TABLE 3

| | Mean Crystal Grain Size (μm) | Ratio of X-ray Diffraction Intensity I{220}/I{420} |
|---|---|---|
| Ex. 1 | 5 | 1.6 |
| Ex. 2 | 5 | 1.6 |
| Ex. 3 | 5 | 1.6 |
| Ex. 4 | 5 | 1.6 |
| Ex. 5 | 5 | 1.7 |
| Ex. 6 | 5 | 1.6 |
| Ex. 7 | 5 | 1.8 |
| Ex. 8 | 5 | 1.7 |
| Ex. 9 | 5 | 1.8 |
| Ex. 10 | 5 | 1.6 |
| Ex. 11 | 6 | 1.6 |
| Ex. 12 | 15 | 1.7 |
| Ex. 13 | 5 | 1.6 |
| Ex. 14 | 5 | 1.6 |
| Ex. 15 | 5 | 1.5 |
| Ex. 16 | 5 | 1.5 |
| Ex. 17 | 5 | 1.6 |
| Ex. 18 | 5 | 1.5 |
| Comp. 1 | 5 | 2.6 |
| Comp. 2 | 5 | 2.7 |
| Comp. 3 | 5 | 2.5 |
| Comp. 4 | 5 | 2.5 |
| Comp. 5 | 2 | 2.4 |

has a crystal orientation satisfying I{220}/I{420}≤2.0 assuming that the X-ray diffraction intensity on {220} crystal plane on the plate surface of the copper alloy plate is I{220} and that the X-ray diffraction intensity on {420} crystal plane thereon is I{420}, as the copper alloy plates in Examples 1-18.

It can be also seen that the stress corrosion cracking resistance, stress relaxation resistance and bending workability of a copper alloy plate are deteriorated if the copper alloy plate contains no silicon and has a crystal orientation satisfying I{220}/I{420}>2.0 by carrying out the hot-rolling at a rolling reduction of less than 10% in a rolling path in a temperature range of 650° C. or lower, as the copper alloy plates in Comparative Examples 1 and 2.

In addition, it can be seen that the stress corrosion cracking resistance and bending workability of a copper alloy plate are deteriorated if the copper alloy plate contains no phosphorus and has a crystal orientation satisfying I{220}/I{420}>2.0 by carrying out the hot-rolling at a rolling reduction of less than 10% in a rolling path in a temperature range of 650° C. or lower, as the copper alloy plates in Comparative Examples 3 and 4.

Moreover, it can be seen that the stress relaxation resistance of a copper alloy plate is deteriorated if the copper alloy plate has a crystal orientation satisfying I{220}/I{420}>2.0 by carrying out the hot-rolling at a rolling reduction of less than 10% in a rolling path in a temperature range of 650° C. or lower and if the copper alloy plate has a mean crystal grain size of 2 μm by carrying out the final intermediate annealing at a temperature of lower than 400° C., as the copper alloy plate in Comparative Example 5.

TABLE 4

| | Conductivity (% IACS) | 0.2% Proof Stress (MPa) | Tensile Strength (MPa) | Stress Relaxation Rate (%) | Stress Corrosion Cracking Resistance Time (h) | Stress Corrosion Cracking Resistance Ratio to C2600 | Bending Workability (R/t) |
|---|---|---|---|---|---|---|---|
| Ex. 1 | 10.1 | 524 | 639 | 20 | 160 | 32 | 0.3 or less |
| Ex. 2 | 9.6 | 531 | 640 | 20 | 199 | 40 | 0.6 |
| Ex. 3 | 9.3 | 535 | 645 | 19 | 324 | 65 | 0.6 |
| Ex. 4 | 14.2 | 526 | 585 | 21 | 135 | 27 | 0.3 |
| Ex. 5 | 13.4 | 532 | 616 | 20 | 165 | 33 | 0.6 |
| Ex. 6 | 13.0 | 530 | 600 | 20 | 250 | 50 | 0.6 |
| Ex. 7 | 16.0 | 545 | 620 | 21 | 124 | 25 | 0.3 |
| Ex. 8 | 15.8 | 549 | 612 | 18 | 150 | 30 | 0.6 |
| Ex. 9 | 14.2 | 576 | 620 | 18 | 135 | 27 | 0.3 or less |
| Ex. 10 | 14.0 | 550 | 650 | 20 | 185 | 37 | 0.3 |
| Ex. 11 | 8.9 | 620 | 714 | 16 | 201 | 40 | 0.6 |
| Ex. 12 | 9.6 | 535 | 610 | 18 | 189 | 38 | 0.6 |
| Ex. 13 | 10.4 | 534 | 638 | 17 | 190 | 38 | 0.3 |
| Ex. 14 | 10.1 | 535 | 640 | 20 | 200 | 40 | 0.6 |
| Ex. 15 | 9.6 | 532 | 641 | 19 | 190 | 38 | 0.3 |
| Ex. 16 | 9.8 | 530 | 635 | 19 | 205 | 41 | 0.3 |
| Ex. 17 | 9.5 | 530 | 632 | 18 | 192 | 38 | 0.3 |
| Ex. 18 | 9.6 | 538 | 640 | 17 | 199 | 40 | 0.6 |
| Comp. 1 | 24.1 | 533 | 587 | 40 | 40 | 8 | 1.0 |
| Comp. 2 | 25.5 | 515 | 600 | 45 | 30 | 6 | 1.0 |
| Comp. 3 | 16.0 | 570 | 621 | — | 92 | 18 | 0.8 |
| Comp. 4 | 13.0 | 591 | 645 | — | 95 | 19 | 0.8 |
| Comp. 5 | 9.0 | 520 | 639 | 40 | 180 | 35 | 0.6 |

It can be seen from Tables 1-4 that it is possible to provide a copper alloy plate having excellent bending workability, excellent stress corrosion cracking resistance and excellent stress relaxation resistance while maintaining the high strength thereof, if the copper alloy plate has a chemical composition comprising 17 to 32% by weight of zinc, 0.1 to 4.5% by weight of tin, 0.5 to 2.0% by weight of silicon, 0.01 to 0.3% by weight of phosphorus, and the balance being copper and unavoidable impurities, the total of the content of silicon and six times as much as the content of phosphorus being 1% by weight or more, and if the copper alloy plate

The invention claimed is:

1. A copper alloy plate which has a chemical composition comprising 17 to 32% by weight of zinc, 0.1 to 4.5% by weight of tin, 0.5 to 2.0% by weight of silicon, 0.01 to 0.3% by weight of phosphorus, and the balance being copper and unavoidable impurities, wherein the total of the content of silicon and six times as much as the content of phosphorus is 1% by weight or more, and wherein the copper alloy plate has a crystal orientation satisfying I{220}/I{420}≤2.0 assuming that the X-ray diffraction intensity on {220} crystal plane on the plate surface of the copper alloy plate is I{220} and that the X-ray diffraction intensity on {420} crystal plane thereon is I{420}.

2. A copper alloy plate as set forth in claim 1, wherein the chemical composition of the copper alloy plate further comprises 1% by weight or less of nickel or cobalt.

3. A copper alloy plate as set forth in claim 1, wherein the chemical composition of the copper alloy plate further comprises one or more elements which are selected from the group consisting of iron, chromium, magnesium, aluminum, boron, zirconium, titanium, manganese, gold, silver, lead, cadmium and beryllium, the total amount of these elements being 3% by weight or less.

4. A copper alloy plate as set forth in claim 1, which has a mean crystal grain size of 3 to 20 μm.

5. A copper alloy plate as set forth in claim 1, which has a tensile strength of not lower than 550 MPa.

6. A copper alloy plate as set forth in claim 1, which has a 0.2% proof stress of not lower than 500 MPa.

7. A copper alloy plate as set forth in claim 1, which has an electric conductivity of not lower than 8% IACS.

8. A method for producing the copper alloy plate of claim 1, the method comprising the steps of:

melting and casting raw materials of a copper alloy which has a chemical composition comprising 17 to 32% by weight of zinc, 0.1 to 4.5% by weight of tin, 0.5 to 2.0% by weight of silicon, 0.01 to 0.3% by weight of phosphorus, and the balance being copper and unavoidable impurities, the total of the content of silicon and six times as much as the content of phosphorus being 1% by weight or more;

hot-rolling the cast copper alloy at a rolling reduction of 90% or more in a temperature range of from 900° C. to 300° C., the hot-rolling being carried out at a rolling reduction of % or more in a rolling path in a temperature range of 650° C. or lower;

intermediate cold-rolling the hot-rolled copper alloy;

intermediate annealing the intermediate cold-rolled copper alloy at a temperature of 400 to 800° C.;

finish cold-rolling the intermediate annealed copper alloy at a rolling reduction of 30% or less; and low-temperature annealing the finish cold-rolled copper alloy at a temperature of 450° C. or lower.

9. A method for producing a copper alloy plate as set forth in claim 8, wherein said rolling reduction in the rolling path in the temperature range of 650° C. or lower in the hot-rolling is 35% or less.

10. A method for producing a copper alloy plate as set forth in claim 8, wherein said intermediate annealing is carried out by a heat treatment in which a holding time and an attainment temperature in a temperature range of from 400° C. to 800° C. are set so that the copper alloy has a mean crystal grain size of 3 to 20 μm after the intermediate annealing.

11. A method for producing a copper alloy plate as set forth in claim 8, wherein the chemical composition of the copper alloy plate further comprises 1% by weight or less of nickel or cobalt.

12. A method for producing a copper alloy plate as set forth in claim 8, wherein the chemical composition of the copper alloy plate further comprises one or more elements which are selected from the group consisting of iron, chromium, magnesium, aluminum, boron, zirconium, titanium, manganese, gold, silver, lead, cadmium and beryllium, the total amount of these elements being 3% by weight or less.

13. A method for producing a copper alloy plate as set forth in claim 8, wherein said intermediate cold-rolling and said intermediate annealing are alternately repeated multiple times.

14. A connector terminal, the material of which is a copper alloy plate as set forth in claim 1.

* * * * *